US008328180B2

(12) United States Patent
Kwak et al.

(10) Patent No.: US 8,328,180 B2
(45) Date of Patent: Dec. 11, 2012

(54) IMAGE FORMING APPARATUS AND PAPER FEEDING METHOD THEREOF

(75) Inventors: Hyun Suk Kwak, Gwangju-si (KR); Young Jae Park, Suwon-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 247 days.

(21) Appl. No.: 12/619,329

(22) Filed: Nov. 16, 2009

(65) Prior Publication Data

US 2010/0156029 A1 Jun. 24, 2010

(30) Foreign Application Priority Data

Dec. 19, 2008 (KR) ..... 10-2008-0130235

(51) Int. Cl.
*B65H 5/00* (2006.01)

(52) U.S. Cl. ..... 271/10.13

(58) Field of Classification Search ..... 271/10.12, 271/10.13

See application file for complete search history.

(56) References Cited

U.S. PATENT DOCUMENTS 4,541,624 A * 9/1985 Sasage et al. ..... 271/12
4,645,192 A * 2/1987 Watanabe ..... 271/9.09
5,056,771 A * 10/1991 Beck et al. ..... 271/114
5,415,387 A * 5/1995 Suzuki ..... 271/10.02
5,681,036 A * 10/1997 Wakahara et al. ..... 271/10.12
5,749,569 A * 5/1998 Atsumi et al. ..... 271/10.11
6,142,467 A * 11/2000 Funada ..... 271/246
7,766,317 B2 * 8/2010 Okuno ..... 271/10.13
2003/0209849 A1 * 11/2003 Lee et al. ..... 271/10.04
2007/0001369 A1 * 1/2007 Murrell et al. ..... 271/10.11
2007/0007706 A1 * 1/2007 Lee ..... 271/10.11

FOREIGN PATENT DOCUMENTS

JP 08-059031 3/1996

OTHER PUBLICATIONS

English language abstract of JP 08-059031, published Mar. 5, 1996.

* cited by examiner

*Primary Examiner* — Prasad Gokhale
(74) *Attorney, Agent, or Firm* — Stanzione & Kim, LLP

(57) ABSTRACT

A paper feeding mechanism, an image forming apparatus employing the same and a paper feeding method thereof are disclosed. In an image forming apparatus capable of performing the printing operations at a particular printing operation that calls for a particular corresponding reference paper feeding speed, a reduction in the paper feeding noise may be achieved by providing a pickup roller operable at pickup/feeding speed that is slower than the reference feeding speed called for by the particular printing speed and a registration roller operable at the reference feeding speed. In addition, the pickup period at which the pickup roller picks up successive sheets of paper may be shortened to account for the slower operating speed of the pickup roller.

18 Claims, 6 Drawing Sheets

IMAGE FORMING APPARATUS AND PAPER FEEDING METHOD THEREOF

CROSS-REFERENCE TO RELATED APPLICATION

This application claims the benefit of Korean Patent Application No. 2008-0130235, filed on Dec. 19, 2008 in the Korean Intellectual Property Office, the disclosure of which is incorporated herein in by reference its entirety.

TECHNICAL FIELD

The present disclosure relates to an image forming apparatus capable of reducing an operational noise and a paper feeding method thereof.

BACKGROUND OF RELATED ART

Generally speaking, an image forming apparatus is an apparatus that forms an image on a printing medium. Examples of image forming apparatuses include a printer, a photocopier, a facsimile, a multifunction apparatus combining some of the functions thereof, and the like.

An image forming apparatus may include a paper feeding unit to store sheets of paper or other printing media, a plurality of rollers to feed the paper, and a printing unit to print images on the paper fed from the paper feeding unit. The paper received in the paper feeding unit may be picked up sheet by sheet by a pickup roller, and may be fed further by one or more rollers, for example, by what is often referred to as a registration roller.

The operation of the registration roller may typically be suspended while the paper is being picked up. When a sheet of paper picked up by the pickup roller comes into contact with the registration roller, the leading end of the paper becomes aligned. In such a state, the registration roller is made to rotate to feed the sheet of paper toward the printing unit.

Efforts to improve the printing speed of such image forming apparatuses has brought about some improvement in the paper feeding speed as well. However, unfortunately, as the paper feeding speed has seen an increase, the noise resulting from the paper colliding with the registration roller has also become a concern. Thus, an image forming apparatus capable of operating at reduced the operational noise is desired.

SUMMARY OF THE DISCLOSURE

In accordance with an embodiment, an image forming apparatus for performing printing operations at a printing speed on printing media may be provided to comprise a print media feeding unit, a printing unit, a registration roller and a pickup roller. The print media feeding unit may be configured to receive therein one or more printing media. The printing unit may be configured to print one or more images on a printing medium received from the print media feeding unit. The registration roller may be configured to feed the printing medium toward the printing unit at a first feeding speed that corresponds to the printing speed. The pickup roller may be configured to pick up the printing medium from the print media feeding unit and to feed the picked-up printing medium to the registration roller at a second feeding speed slower than the first feeding speed.

The pickup roller may be configured to feed the print media to the registration roller at a second pickup period between each successive ones of the printing media, the second pickup period being shorter than a first pickup period at which the pickup roller operating at the first feeding speed would have fed the printing media.

The second pickup period may satisfy the relationship defined by: $T2=T1-(A/V2-A/V1)$. T1 and T2 denote the first and second pickup periods, respectively. A denotes a distance the printing medium travels between the pickup roller and the registration roller. V1 and V2 denotes the first feeding speed and the second feeding speed, respectively.

The image forming apparatus may further comprise a pickup motor, a first power control unit and a second power control unit. The pickup motor may be configured to produce a motional power. The first power control unit may be configured to control transmission of the motional power from the pickup motor to the pickup roller. The second power control unit may be configured to control transmission of the motional power from the pickup motor to the registration roller.

The image forming apparatus may further comprise a control unit that may be configured to control the first power control unit so that the pickup roller picks up the printing media at the second pickup period.

The image forming apparatus may further comprise a pickup roller shaft and a pickup gear. The pickup roller may be rotatable about the pickup roller shaft. The pickup gear may be mounted to the pickup roller shaft, and may have a stopper on one side thereof. The first power control unit may comprise a locking member and an actuator. The locking member may be configured to be in a locked position in which the locking member is in an interfering contact with the stopper of the pickup gear and in a released position in which the locking member is separated from the stopper. The actuator may be configured to cause the locking member to move selectively into one of the locking position and the released position.

According to another aspect of the present disclosure, an image forming apparatus for performing printing operations at a printing speed on printing media may be provided to comprise a print media feeding unit, a printing unit, a registration roller, a pickup roller, a pickup motor, a power control unit and a control unit. The print media feeding unit may be configured to receive therein one or more printing media. The printing unit may be configured to print one or more images on a printing medium received from the print media feeding unit. The registration roller may be configured to feed the printing medium toward the printing unit at a first feeding speed that corresponds to the printing speed. The pickup roller may be configured to pick up the printing medium from the print media feeding unit and to feed the picked-up printing medium to the registration roller at a second feeding speed slower than the first feeding speed. The pickup motor may be configured to produce a motional power. The power control unit may be configured to control transmission of the motional power from the pickup motor to the pickup roller. The control unit may be configured to control the power control unit so that the pickup roller picks up the printing media at a shorter pickup period between each successive ones of the printing media. The shorter pickup period may be shorter than a normal pickup period at which the pickup roller operating at the first feeding speed would have picked up the printing media.

The shorter pickup period may satisfy the relationship: $T2=T1-(A/V2-A/V1)$. T1 and T2 denotes the normal pickup period and the shorter pickup period, respectively. A denotes a distance the printing medium travels between the pickup roller and the registration roller. V1 and V2 denote the first and second feeding speeds, respectively.

According to yet another aspect of the present disclosure, a method of feeding printing media in an image forming apparatus may be provided. The image forming apparatus may include a printing unit, a registration roller configured to feed the print media to the printing unit at a first feeding speed and a pickup roller configured to pick up the print media and to feed the picked up print media to the registration roller. The method may comprise: operating the pickup roller to feed the printing media to the registration roller at a second feeding speed slower than the first feeding speed; and operating the pickup roller to pick up the printing media at a pickup period that is shorter than a reference pickup period at which the pickup roller operating at the first feeding speed would have picked up the printing media.

The pickup period may satisfy: $T2=T1-(A/V2-A/V1)$. T1 and T2 denote the reference pickup period and the pickup period, respectively. A denotes a distance the printing medium travels between the pickup roller and the registration roller. V1 and V2 denote the first and second feeding speeds, respectively.

According to even yet another aspect of the present disclosure, an apparatus for feeding printing media along a printing media feed path of an image forming apparatus may comprise a pickup roller, a registration roller and a controller. The pickup roller may be rotatably arranged in the printing media feed path, and may be configured to pick up successive ones of the printing media. The registration roller may be rotatably arranged in the printing media feed path downstream of the pickup roller so as to receive the successive ones of printing media picked up by the pickup roller, and may be configured to feed the received successive ones of printing media further along the printing media feed path. The controller may be configured to control respective operations of the pickup roller and the registration roller in such a manner that the registration roller rotates at a first rotational speed and that the pickup roller rotates at a second rotational speed slower than a first rotational speed.

The apparatus may further comprise a motor configured to produce a rotational power and a rotational power transmission mechanism. The rotational power transmission mechanism may be configured to receive the rotational power produced by the motor and to convey the received rotational power to the pickup roller and to the registration roller. The controller may be configured to control the rotational power transmission mechanism so as to cause the registration roller to feed the printing media received from the pickup roller further along the printing media feed path at a first time interval between each successive ones of the printing media and to cause the pickup roller to pick up the successive ones of printing media at a second time interval therebetween, the second time interval being shorter than the first time interval.

The second time interval may satisfy a relationship defined by: $T2=T1-(A/V2-A/V1)$. T1 and T2 denote the first time interval and the second time interval, respectively. A denotes a distance a printing medium travels between the pickup roller and the registration roller. V1 and V2 denote the first and second rotational speeds, respectively.

The rotational power transmission mechanism may comprise a driving gear, a pickup roller shaft, a pickup gear, a locking member and an actuator. The driving gear may be arranged to receive the rotational power produced by the motor, and may be configured to rotate responsive to the received rotational power. The pickup roller shaft may support thereon the pickup roller in such a manner the pickup roller and the pickup roller shaft rotate together. The pickup gear may be mounted to the pickup roller shaft in such a manner the pickup gear and the pickup roller shaft are rotatable together, and may be configured to engage the driving gear to thereby receive the rotational power therefrom. The pickup gear may include a stopper extending from a side face thereof. The locking member may be configured to be in a locked position in which the locking member is in an interfering contact with the stopper of the pickup gear and in a released position in which the locking member is separated from the stopper. The actuator may be configured to cause the locking member to move selectively into one of the locking position and the released position.

The pickup gear may comprise a first clutch gear and a second clutch gear, each of which may have a geared section in which a set of gear teeth is provided and a non-geared section without gear teeth. When the locking member is in the locked position, the first and second clutch gears may become coupled in such alignment with respect each other that the respective non-geared section of each of the first and second clutch gears face the driving gear so that the driving gear does not engage the pickup gear.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
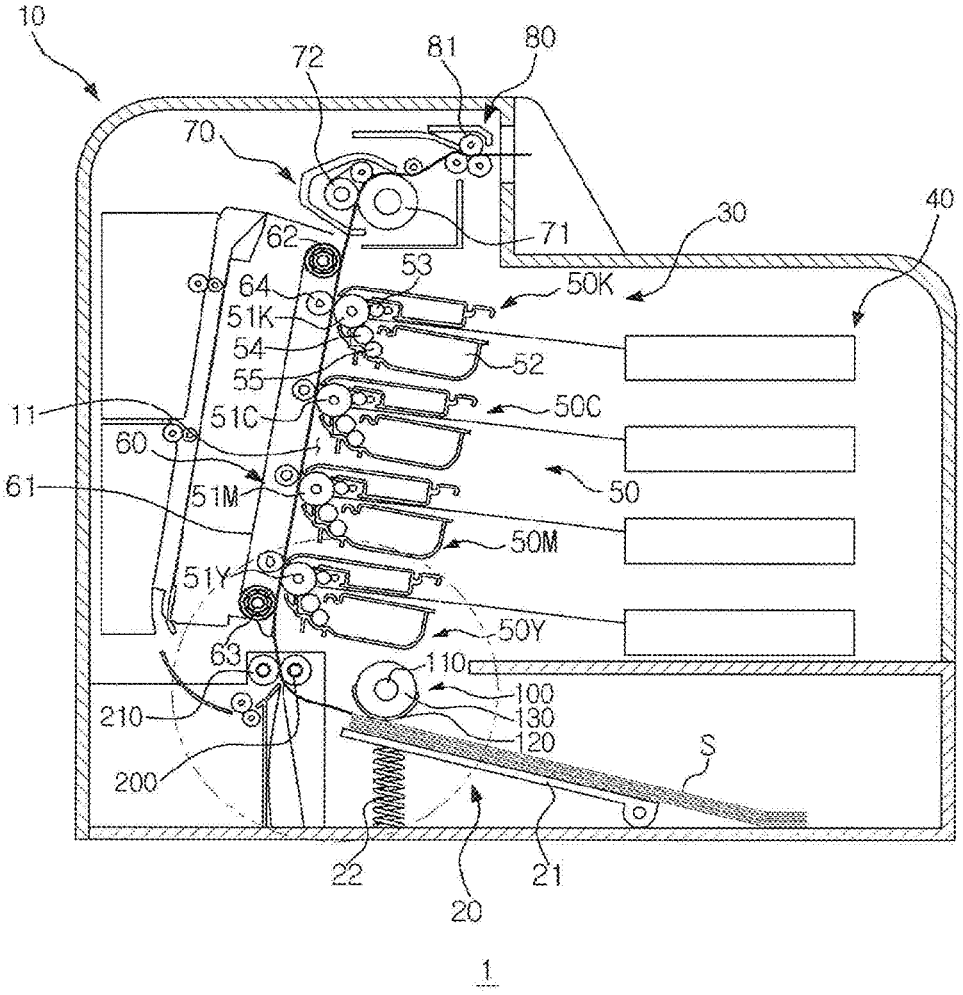
FIG. 1 is a view illustrating the structure of an image forming apparatus according to an embodiment.

Reference will now be made in detail to the embodiment, examples of which are illustrated in the accompanying drawings, wherein like reference numerals refer to like elements throughout. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 illustrates a structure of an image forming apparatus according to an embodiment.

Referring to FIG. 1, the image forming apparatus 1 may include a main body 10, a paper feeding unit 20, a pickup roller 100, a registration roller 200, a printing unit 30 and a paper discharging unit 80.

The main body 10 may define the overall exterior appearance of the image forming apparatus 1, and may support various constituent parts of the image forming apparatus 1 therein. A paper feeding path 11 may be defined inside the main body 10. A sheet of paper S fed by the paper feeding unit 20 may move along the paper feeding path 11, and may be discharged out of the main body 10 through the discharging unit 80.

The paper feeding unit 20 may receive a supply of paper S that will be supplied as a printing medium. It should be noted that, while paper is being described as an example of a printing medium, the printing medium is not limited to paper, and that other materials may be utilized. According to an embodiment, the paper feeding unit 20 may include a paper tray 21 and a spring 22 configured to elastically support the paper tray 21.

The pickup roller 100 may be configured to pick up the paper from the paper tray 21 sheet by sheet, and may convey the picked-up paper to the registration roller 200. The pickup roller 100 may be mounted to a pickup roller shaft 110. The pickup roller 100 may include a rotating pickup member 120 and a pair of idle rollers 130 that may be mounted on both sides of the rotating pickup member 120, and that may rotate idly.

The rotating pickup member 120 may includes a contact part 121 (shown in FIG. 3) in a predetermined section thereof to contacts the paper while the rotating pickup member 120 rotates. The contact part 121 may protrude in a radial direction from the idle roller 130. As shown in FIG. 1, when the contact part 121 of the rotating pickup member 120 is in contact with the paper, the idle roller 130 may be separated from the paper. On the other hand, when the contact part 121 is not in contact with the paper, the idle roller 130 may be in contact with the paper.

The registration roller 200 may be configured to feed the paper picked up by the pickup roller 100 toward the printing unit 30. The registration roller 200 may be configured to, receive the paper from the pickup roller 100 in a suspended or non-rotating state to align the leading end of the sheet(s) of paper, and to then rotate to feed the paper to the printing unit 30. A pinch roller 210 may be mounted to face the registration roller 200, and to feed the paper by rotating with the registration roller 200.

The printing unit 30 may be configured to print images on the paper fed from the paper feeding unit 20. According to an embodiment, which, by way of an illustrative example, may be an electrophotographic type image forming apparatus, the printing unit 30 may further include an exposure unit 40, a developing unit 50, a transfer unit 60 and a fixing unit 70. It should be noted however that other types of image forming apparatus that include other types of printing unit, for example, an inkjet type printing unit, are also contemplated to be within the scope of one or more aspects of the present disclosure.

Referring to FIG. 1, according to an embodiment, the developing unit 50 may include a plurality of developing devices for developing developer (e.g., toner) images of respective different colors. For example, four developing devices 50Y, 50M, 50C and 50K may respectively store yellow (Y), magenta (M), cyan (C) and black (K) toners therein. The developing devices 50Y, 50M, 50C and 50K may be equipped with photoconductive mediums 51Y, 51M, 51C and 51K, respectively, to form an electrostatic latent image on a surface thereof. The exposure units 40Y, 40M, 40C and 40K may be configured to emit light corresponding to image data of yellow, magenta, cyan and black images to the respective photoconductive mediums 51Y, 51M, 51C and 51K in accordance with printing signals.

Each of the developing devices 50Y, 50M, 50C and 50K may include a toner storage 52, a charging roller 53 configured to electrify the photoconductive medium 51Y, 51M, 51C or 51K, a developing roller 54 configured to form a visible toner image by supplying the toner to the electrostatic latent image formed on the photoconductive medium 51Y, 51M, 51C or 51K, and a supplying roller 55 configured to supply the toner to the developing roller 54.

The transfer unit 60 may includes a transfer belt 61 configured to rotate while facing the photoconductive mediums 51Y, 51M, 51C and 51K, a driving roller 62 configured to rotate the transfer belt 61, a tension roller 63 configured to maintain predetermined tension of the transfer belt 61 and transfer rollers 64 configured to transfer to the paper the visible toner image formed on the photoconductive mediums 51Y, 51M, 51C and 51K.

The paper may be fed from the paper feeding unit 20 in contact with the transfer belt 61. The toner images on the photoconductive mediums 51Y, 51M, 51C and 51K may be transferred to in a manner overlapping one another on the paper by the transfer rollers 64.

After passing through the transfer unit 60, the paper may be guided to the fixing unit 70 that may include a heating roller 71 and a pressing roller 72. The paper bearing the transferred image thereon may be passed between the heating roller 71 and the pressing roller 72, during which the image is fixed to the paper by the heat and pressure.

The paper passed through the fixing unit 70 may be guided to the paper discharging unit 80 and then discharged by a discharging roller 81.

Figure 2:
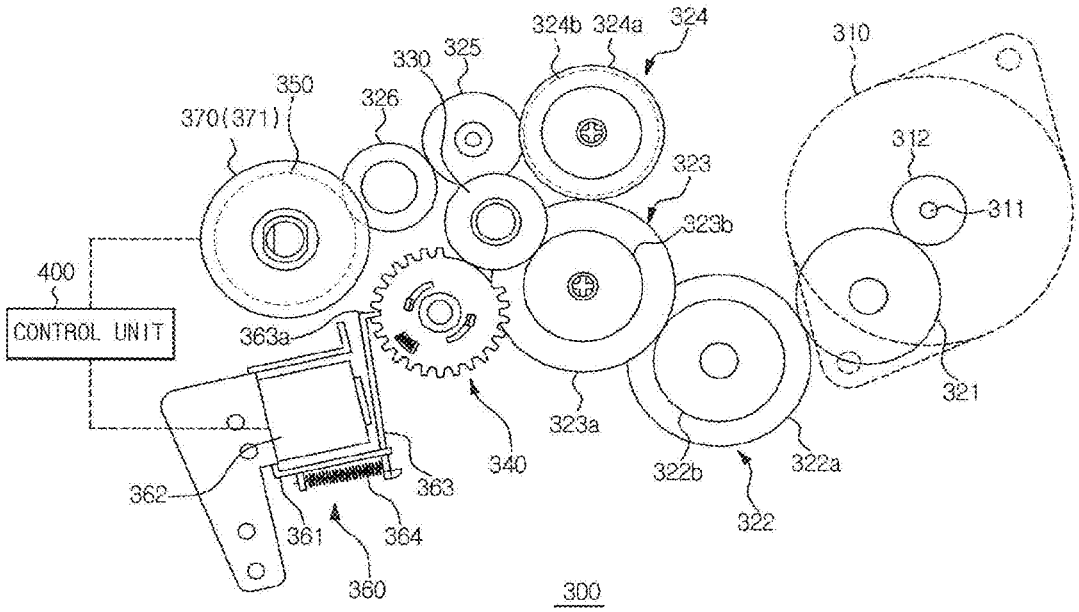
FIG. 2 is a view illustrating the structure of a driving device driving a pickup roller and a registration roller of an image forming apparatus according to an embodiment.
Figure 3:
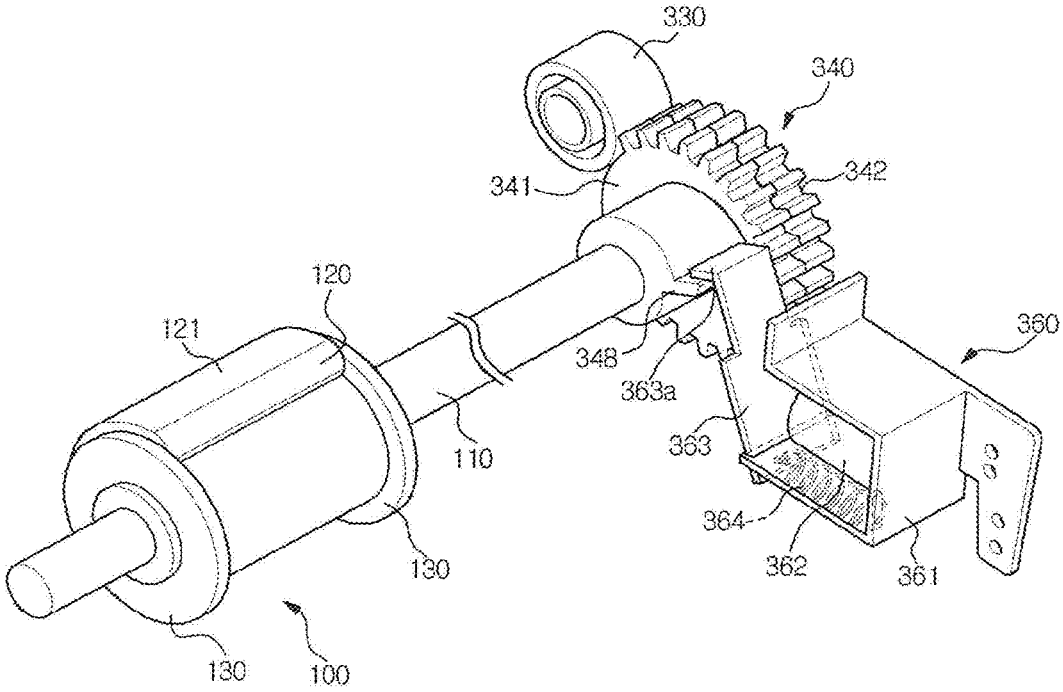
FIG. 3 is a view illustrating a pickup gear and a first power control unit according to an embodiment.
Figure 4:
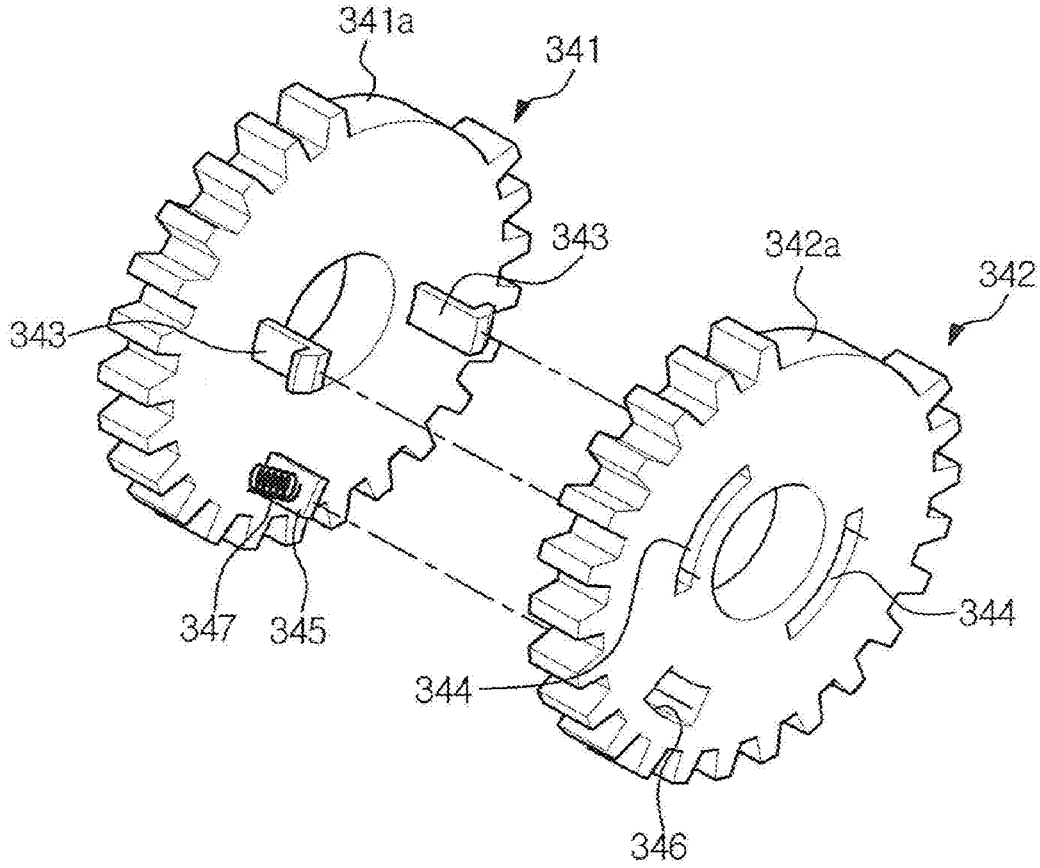
FIG. 4 is an exploded perspective view of the pickup gear of FIG. 3.

FIG. 2 illustrates a structure of a driving device that is configured to operate the pickup roller 100 and the registration roller 200 in the image forming apparatus, according to an embodiment. FIG. 3 illustrates a pickup gear and a first power control unit of the image forming apparatus, according to an embodiment. FIG. 4 provides further details related to the pickup gear shown in FIG. 3.

Referring to FIG. 2, the image forming apparatus 1 may include a driving device 300 that is configured to drive the pickup roller 100 and the registration roller 200.

The driving device 300 according to an embodiment may include a pickup motor 310, first to sixth power transmission gears 321, 322, 323, 324, 325 and 326, a first power control unit 360 and a second power control unit 370.

The pickup motor 310 may include a rotating shaft 311 and a pinion gear 312 mounted to the rotating shaft 311. The pinion gear 312 may be meshed with a first power transmission gear 321. The first power transmission gear 321 may be meshed with a first gear part 322*a* of a second power transmission gear 322. A second gear part 322*b* of the second power transmission gear 322 may be meshed with a first gear part 323*a* of a third power transmission gear 323. A second gear part 323*b* of the third power transmission gear 323 may be meshed with a pickup driving gear 330. Thus, as the rotating shaft 311 of the pickup motor 310 rotates, the rotational power is transmitted through the pinion gear 312 and the first to third power transmission gears 321, 322 and 323, thereby rotating the pickup driving gear 330.

As shown in FIG. 3, the pickup gear 340 may be mounted to an end of the pickup roller shaft 110. The pickup gear 340 may include a first clutch gear 341 and a second clutch gear 342 parallel with the first clutch gear 341.

While generally configured to be meshed with the pickup driving gear 330, the first and the second clutch gears 341 and 342 may include ungeared parts 341*a* and 342*a*, respectively, at a predetermined section thereof (see FIG. 4). The ungeared parts 341*a* and 342*a* do not have gear teeth so as not to be meshed with the pickup driving gear 330.

With reference to FIG. 4, a hook 343 may be formed on an outer surface of the first clutch gear 341 for connection with the second clutch gear 342. The second clutch gear 342 may include a connection hole 344 for engagement of the hook 343 of the first clutch gear 341. As the first and the second clutch gears 341 and 342 are coupled to each other, the hook 343 engages the connection hole 344 and is caught at an outer surface of the second clutch gear 342. The connection hole 344 may include a slot that extends in a circumferential direction so that the first clutch gear 341 may rotate relative to the second clutch gear 342.

Additionally, a supporting projection 345 may be formed on the outer surface of the first clutch gear 341 while an insertion hole 346 to engage the supporting projection 345 may be formed on the second clutch gear 342. In the same manner as the connection hole 344, the insertion hole 346 may be extended by a predetermined length along the circumference of the second clutch gear 342. The supporting projection 345 may be equipped with an elastic member 347. When the first clutch gear 341 is coupled to the second clutch gear 342, one end of the elastic member 347 may be supported by the insertion hole 346 while the other end may be supported by the supporting projection 345 inserted in the insertion hole 346.

The first power control unit 360 may be configured to restrict the movement of the first clutch gear 341, thereby controlling power transmission to the pickup gear 340.

With reference again to FIG. 3, the first clutch gear 341 may include a stopper 348 that may be restricted by the first power control unit 360. As shown in FIG. 3, in a state where rotation of the first clutch gear 341 is restricted by the stopper 348 being held by the first power control unit 360, the first ungeared part 341*a* and the second ungeared part 342*a* may correspond to each other. Therefore, a rotating force of the pickup driving gear 330 is not transmitted to the pickup gear 340.

However, when the first power control unit 360 releases the stopper 348, the first clutch gear 341 is rotated relative to the second clutch gear 342 by elasticity of the elastic member 347. Accordingly, the first and the second ungeared parts 341*a* and 342*a* disaccord and are unaligned with each other. Therefore, the first clutch gear 341 is meshed with the pickup driving gear 330, and the rotating force of the pickup driving gear 330 is transmitted to the pickup gear 340.

The first power control unit 360 may include a bracket 361, an actuator 362 supported by the bracket 361, and a locking member 363 operated by the actuator 362 between a locked position, in which the locking member 363 may be in an interfering contact with the stopper 348 of the first clutch gear 341, and a released position, in which the locking member 363 is separated from the stopper 348.

The locking member 363 may be pivotingly or hingedly supported on the bracket 361. A locking part 363*a* may be formed at one end of the locking member 363, and may extend toward the stopper 348. In addition, a spring 364 may be provided at the other end of the locking member 363 to elastically bias the end of the locking member 363 toward the direction of moving the locking part 363*a* into the locked position.

With the above configuration, as a current is applied to the actuator 362, the locking member 363 is pulled toward the actuator 362 by a magnetic force. Accordingly, the locking part 363*a* of the locking member 363 may separate to be spaced apart from the stopper 348 of the first clutch gear 341. On the other hand, when no current is applied to the actuator 362, the locking part 363*a* may move toward the stopper 348 by the elasticity of the spring 364, thereby restricting the stopper 348.

As shown in FIG. 2, the first gear part 323*a* of the third power transmission gear 323 may be meshed with a first gear part 324*a* of the fourth power transmission gear 324 while a second gear part 324*b* of the fourth power transmission gear 324 may be meshed with the fifth power transmission gear 325. The fifth power transmission gear 325 may be connected to the sixth power transmission gear 326, and the sixth power transmission gear 326 may be meshed with a registration roller gear 350. Accordingly, the rotating force of the driving motor 310 is transmitted to the registration roller 200 through the first to the sixth power transmission gears 321, 322, 323, 324, 325 and 326.

The second power control unit 370 may be configured to control power transmitted to the registration roller gear 350. The second power control unit 370 may include an electromagnet clutch 371. When the electromagnet clutch 371 is turned on, according to an embodiment, power may be transmitted to the registration roller gear 350. When the electromagnet clutch 371 is turned off, the power transmission to the registration roller gear 350 may be interrupted.

The image forming apparatus 1 may further include a control unit 400, which may be configured to control the operations of the first and the second power control units 360 and 370. In particular, the control unit 400 may control the pickup, alignment, and feeding of the paper by controlling the on and off states of the power control units 360 and 370. While a detailed structure of the control unit 400 is not depicted in FIG. 2, as would be readily understood by those skilled in the art, the control unit 400 may be, e.g., a microprocessor, a microcontroller or the like, that includes a CPU to execute one or more computer instructions to implement the various control operations herein described and/or control operations relating to the feeding unit 20 or to other components of the image forming apparatus, such as, for example, one or more of the exposure unit, the developing units, the transfer unit and the discharging unit, and to that end may further include a memory device, e.g., a Random Access Memory (RAM), Read-Only-Memory (ROM), a flesh memory, or the like, to store the one or more computer instructions.

Figure 5:
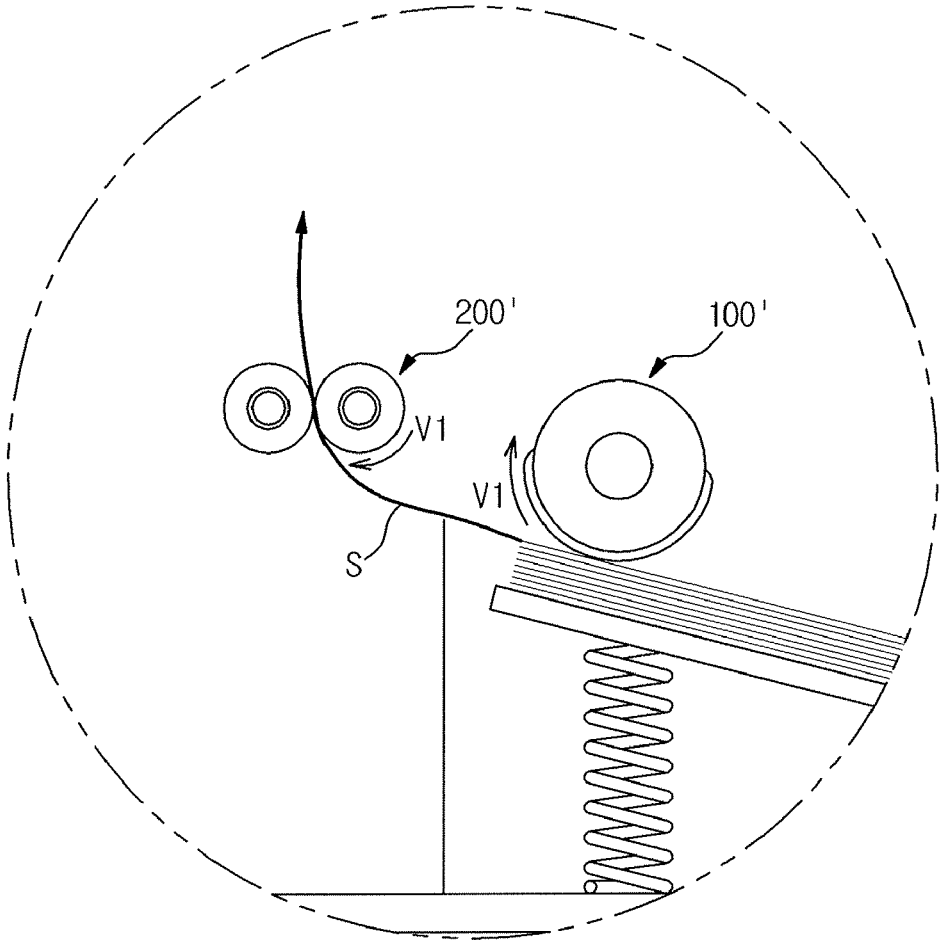
FIG. 5 (RELATED ART)
FIG. 5 illustrates operating states of a pickup roller and a registration roller of a conventional image forming apparatus performing printing at a set speed.
Figure 6:
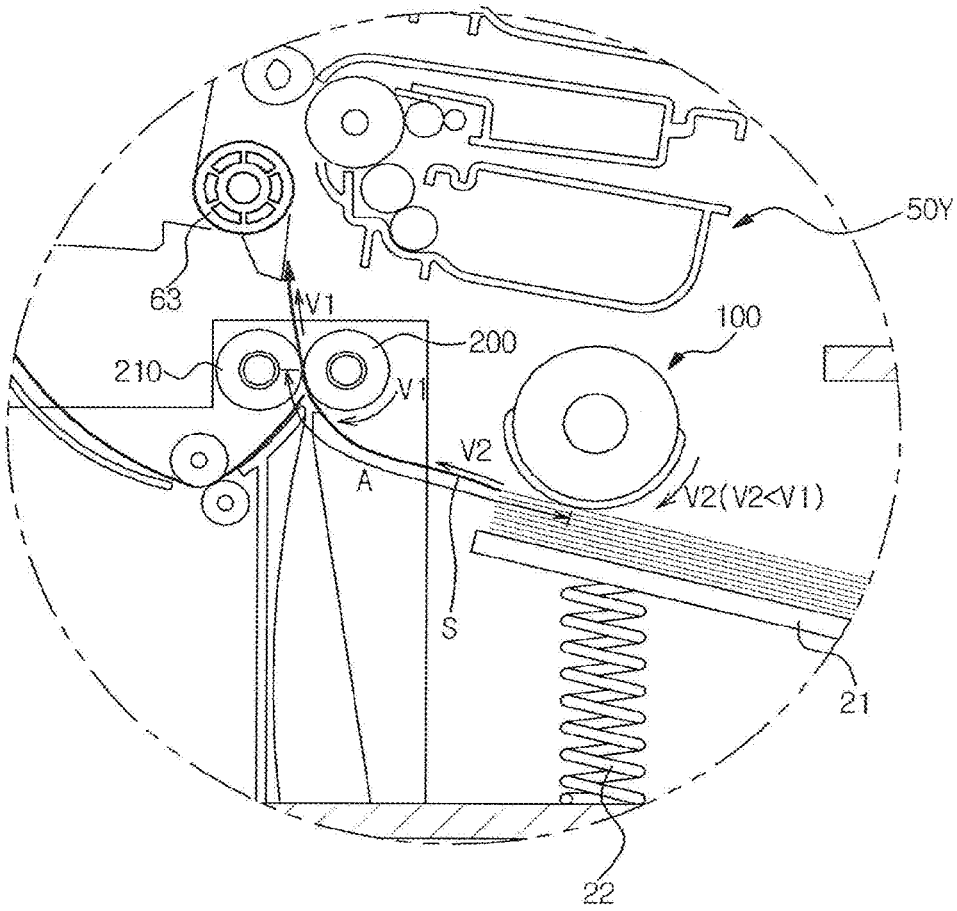
FIG. 6 illustrates operating states of the pickup roller and the registration roller in the image forming apparatus according to an embodiment.

FIG. 5 illustrates operation of a pickup roller and a registration roller when a general conventional image forming apparatus is printing on the paper at a set speed. FIG. 6 illustrates operation of the pickup roller and the registration roller when the image forming apparatus, according to an embodiment, is printing on the paper at a set speed.

Assuming the conventional image forming apparatus performs printing at a set printing speed Vp on sheets of paper being fed at a predetermined distance interval D, a processing speed V1 from pickup to discharge of a sheet of paper may be calculated according to the Equation 1 below. Hereinafter, the processing speed V1 will be referred to as a first feeding speed.

$$V1=(L+D)\times Vp/60 \qquad \text{[Equation 1]}$$

In the Equation 1 above, L denotes the length of the paper while D denotes the interval between the sheets of paper being fed, both of which may be expressed in millimeters (mm). The unit of Vp may be pages per minute (PPM). The unit of the first feeding speed V1 is mm/s.

When printing is performed at the set printing speed Vp with the papers being fed by the predetermined distance interval D, as shown in FIG. 5, a pickup roller 100' of a conventional image forming apparatus may be rotated at the first feeding speed V1 to pick up and to feed a sheet of paper S. A registration roller 200' of the conventional image forming apparatus may also rotate at the first feeding speed V1 to feed the paper S. The linear velocity of the rollers 100' and 200' may equal the paper feeding speed, ignoring any slip between the paper and the rollers 100' and 200'. Although the pickup roller 100' may generally be structured to rotate faster than the registration roller 200', the speed difference between the pickup roller 100' and the registration roller 200' is typically very small, and may thus be negligible.

However, if the pickup roller 100' and the registration roller 200' feed the paper at substantially the same speed, in a high-speed printing mode, for example, a significant noise may be produced during alignments of the leading ends of the sheets of paper. That is, the first feeding speed V1 is increased as the set printing speed Vp increases. Therefore, as the paper being fed at the increased first feeding speed V1 collides with the registration roller 200', a louder collision noise may be generated.

In the image forming apparatus 1 as shown in FIG. 6, according to an embodiment, the pickup roller 100 may be structured to rotate at a second feeding speed V2, which is slower than the first feeding speed V1, when feeding the paper.

According to the embodiment, as described above, if the pickup roller 100 picks up and feeds the paper at a slower speed than the speed of the registration roller 200, a time delay may be generated between the pickup of the paper by the pickup roller 100 and the feeding of the paper to the registration roller 200, and accordingly may result in the printing being performed at a slower speed than the set printing speed Vp.

The image forming apparatus 1 according to an embodiment may adjust the pickup period of the pickup roller 100, where the pickup period is the time duration from after pickup of one sheet of paper to pickup of the next sheet of paper by the pickup roller 100. The adjusted pickup period may compensate for the time delay caused by the slower rotating speed of the pickup roller 100.

According to an embodiment, the control unit 400 may control the on and off operational period of the first power control unit 360 so that the pickup roller 100 picks up the paper during a second pickup period T2, which is shorter than a first pickup period T1. The first pickup period T1 refers to a pickup period when the pickup roller 100 picks up and feeds the paper at the first feeding speed V1.

If 'A' denotes the distance between the pickup roller 100 and the registration roller 200 along the paper feeding path, the second pickup period T2 may be calculated according to the Equation 2 below.

$$T2=T1-(A/V2-A/V1) \quad \text{[Equation 2]}$$

The control unit 400 may maintain the off state of the electromagnetic clutch 371 until the paper fed by the pickup roller 100 at the second feeding speed V2 reaches the registration roller 200, allowing the registration roller 200 to align the leading ends of the papers. Next, the control unit 400 turns on the electromagnet clutch 371 so that the driving force of the driving motor 310 is transmitted to the registration roller gear 350. Accordingly, the registration roller 200 feeds the paper to the printing unit 30 at the first feeding speed V1.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. An image forming apparatus for performing printing operations at a printing speed on printing media, comprising:

a print media feeding unit configured to receive therein one or more printing media;

a printing unit configured to print one or more images on a printing medium received from the print media feeding unit;

a registration roller configured to feed the printing medium toward the printing unit at a first feeding speed that corresponds to the printing speed;

a pickup roller configured to pick up the printing medium from the print media feeding unit and to feed the picked-up printing medium to the registration roller at a second feeding speed slower than the first feeding speed;

a pickup roller shaft about which the pickup roller is rotatable; and a pickup gear mounted to the pickup roller shaft, the pickup gear including a first clutch gear and a second clutch gear configured to engage each other in a direction parallel to an axial direction of the pickup roller shaft, the second clutch gear including a connection hole and the first clutch gear including a hooked protrusion configured to engage the connection hole to couple the first and second clutch gears together.

2. The image forming apparatus according to claim 1, wherein the pickup roller is configured to feed the print media to the registration roller at a second pickup period between each successive ones of the printing media, the second pickup period being shorter than a first pickup period corresponding to the first feeding speed.

3. The image forming apparatus according to claim 2, wherein the second pickup period satisfies: T2=T1−(A/V2−A/V1), and wherein T1 and T2 denote the first and second pickup periods, respectively, A denoting a distance the printing medium travels between the pickup roller and the registration roller, V1 and V2 denoting the first feeding speed and the second feeding speed, respectively.

4. The image forming apparatus according to claim 2, further comprising:

a pickup motor configured to produce a motional power;

a first power control unit configured to control transmission of the motional power from the pickup motor to the pickup roller; and a second power control unit configured to control transmission of the motional power from the pickup motor to the registration roller.

5. The image forming apparatus according to claim 4, further comprising a control unit configured to control the first power control unit so that the pickup roller picks up the printing media at the second pickup period.

6. The image forming apparatus according to claim 5, wherein the pickup gear includes a stopper on one side thereof, and wherein the first power control unit comprises:

a locking member configured to be in a locked position in which the locking member is in an interfering contact with the stopper of the pickup gear and in a released position in which the locking member is separated from the stopper; and an actuator configured to cause the locking member to move selectively into one of the locking position and the released position.

7. The image forming apparatus according to claim 1, wherein the connection hole includes a slotted portion that extends in a circumferential direction of the second clutch gear, the slotted portion configured to accept the hooked protrusion so as to allow for the first clutch gear and the second clutch gear to rotate relative to each other.

8. The image forming apparatus according to claim 7, wherein the second clutch gear includes an insertion hole and the first clutch gear includes a supporting protrusion configured to engage the insertion hole.

9. The image forming apparatus according to claim 8, wherein the supporting protrusion includes a biasing member configured to bias the second clutch gear in the circumferential direction of the second clutch gear.

10. An image forming apparatus for performing printing operations at a printing speed on printing media, comprising:

a print media feeding unit configured to receive therein one or more printing media;

a printing unit configured to print one or more images on a printing medium received from the print media feeding unit;

a registration roller configured to feed the printing medium toward the printing unit at a first feeding speed that corresponds to the printing speed;

a pickup roller configured to pick up the printing medium from the print media feeding unit and to feed the picked-up printing medium to the registration roller at a second feeding speed slower than the first feeding speed;

a pickup roller shaft about which the pickup roller is rotatable;

a pickup gear mounted to the pickup roller shaft, the pickup gear including a first clutch gear and a second clutch gear configured to engage each other in a direction parallel to an axial direction of the pickup roller shaft, the second clutch gear including a connection hole and the first clutch gear including a hooked protrusion configured to engage the connection hole to couple the first and second clutch gears together;

a pickup motor configured to produce a motional power;

a power control unit configured to control transmission of the motional power from the pickup motor to the pickup roller; and a control unit configured to control the power control unit so that the pickup roller picks up the printing media at a shorter pickup period between each successive ones of the printing media, wherein the shorter pickup period is shorter than a normal pickup period corresponding to the first feeding speed.

11. The image forming apparatus according to claim 10, wherein the shorter pickup period satisfies: $T2=T1-(A/V2-A/V1)$, and wherein T1 and T2 denote the normal pickup period and the shorter pickup period, respectively, A denoting a distance the printing medium travels between the pickup roller and the registration roller, V1 and V2 denoting the first and second feeding speeds, respectively.

12. A method of feeding printing media in an image forming apparatus having a printing unit, a registration roller configured to feed the print media to the printing unit at a first feeding speed and a pickup roller configured to pick up the print media and to feed the picked up print media to the registration roller, the method comprising:

operating the pickup roller to feed the printing media to the registration roller at a second feeding speed slower than the first feeding speed, the pickup roller being rotatably disposed on a pickup roller shaft that includes a pickup gear having a first clutch gear and a second clutch gear configured to engage each other in a direction parallel to an axial direction of the pickup roller shaft, the second clutch gear including a connection hole and the first clutch gear including a hooked protrusion configured to engage the connection hole to couple the first and second clutch gears together; and operating the pickup roller to pick up the printing media at a pickup period that is shorter than a reference pickup period corresponding to the first feeding speed.

13. The method according to claim 12, wherein the pickup period satisfies: $T2=T1-(A/V2-A/V1)$, and wherein T1 and T2 denote the reference pickup period and the pickup period, respectively, A denoting a distance the printing medium travels between the pickup roller and the registration roller, V1 and V2 denoting the first and second feeding speeds, respectively.

14. An apparatus for feeding printing media along a printing media feed path of an image forming apparatus, comprising:

a pickup roller rotatably arranged in the printing media feed path and configured to pick up successive ones of the printing media;

a registration roller rotatably arranged in the printing media feed path downstream of the pickup roller so as to receive the successive ones of printing media picked up by the pickup roller, the registration roller being configured to feed the received successive ones of printing media further along the printing media feed path;

a controller configured to control respective operations of the pickup roller and the registration roller in such a manner that the registration roller rotates at a first rotational speed and that the pickup roller rotates at a second rotational speed slower than a first rotational speed;

a pickup roller shaft about which the pickup roller is rotatable; and a pickup gear mounted to the pickup roller shaft, the pickup gear including a first clutch gear and a second clutch gear configured to engage each other in a direction parallel to an axial direction of the pickup roller shaft, the second clutch gear including a connection hole and the first clutch gear including a hooked protrusion configured to engage the connection hole to couple the first and second clutch gears together.

15. The apparatus of claim 14, further comprising:

a motor configured to produce a rotational power;

a rotational power transmission mechanism configured to receive the rotational power produced by the motor and to convey the received rotational power to the pickup roller and to the registration roller, wherein the controller is configured to control the rotational power transmission mechanism so as to cause the registration roller to feed the printing media received from the pickup roller further along the printing media feed path at a first time interval between each successive ones of the printing media and to cause the pickup roller to pick up the successive ones of printing media at a second time interval therebetween, the second time interval being shorter than the first time interval.

16. The apparatus of claim 15, wherein the second time interval satisfies a relationship defined by: $T2=T1-(A/V2-A/V1)$, and wherein T1 and T2 denote the first time interval and the second time interval, respectively, A denoting a distance a printing medium travels between the pickup roller and the registration roller, V1 and V2 denoting the first and second rotational speeds, respectively.

17. The apparatus of claim 15, wherein the rotational power transmission mechanism comprises:

a driving gear arranged to receive the rotational power produced by the motor and configured to rotate responsive to the received rotational power;

a locking member configured to be in a locked position in which the locking member is in an interfering contact with the stopper of the pickup gear and in a released position in which the locking member is separated from the stopper, the pickup gear to engage the driving gear to thereby receive the rotational power therefrom and being rotatable together with the pickup roller shaft, the pickup gear including a stopper extending from a side face thereof, the pickup roller shaft supporting thereon the pickup roller such that the pickup roller and the pickup roller shaft rotate together; and an actuator configured to cause the locking member to move selectively into one of the locking position and the released position.

18. The apparatus of claim 17, wherein the first clutch gear and the second clutch gear each have a geared section in which a set of gear teeth is provided and a non-geared section without gear teeth, and wherein, when the locking member is in the locked position, the first and second clutch gears become coupled in such alignment with respect each other that the respective non-geared section of each of the first and second clutch gears face the driving gear so that the driving gear does not engage the pickup gear.

* * * * *